US009057239B2

(12) United States Patent
Young

(10) Patent No.: US 9,057,239 B2
(45) Date of Patent: Jun. 16, 2015

(54) METHOD AND APPARATUS FOR SECURING A LUBRICATOR AND OTHER EQUIPMENT IN A WELL

(76) Inventor: James L. Young, Lafayette, LA (US)

( * ) Notice: Subject to any disclaimer, the term of this patent is extended or adjusted under 35 U.S.C. 154(b) by 240 days.

(21) Appl. No.: 13/589,586

(22) Filed: Aug. 20, 2012

(65) Prior Publication Data

US 2013/0048309 A1 Feb. 28, 2013

Related U.S. Application Data

(60) Provisional application No. 61/525,998, filed on Aug. 22, 2011, provisional application No. 61/622,060, filed on Apr. 10, 2012.

(51) Int. Cl.

| | |
|---|---|
| ***E21B 33/038*** | (2006.01) |
| ***E21B 33/072*** | (2006.01) |
| ***E21B 23/00*** | (2006.01) |
| *E21B 19/00* | (2006.01) |

(52) U.S. Cl.

CPC ..... *E21B 33/038* (2013.01); *E21B 19/00* (2013.01); *E21B 23/00* (2013.01); *E21B 33/072* (2013.01)

(58) Field of Classification Search

CPC ..... E21B 23/02; E21B 33/038; E21B 33/072; F16L 25/065

USPC ..... 166/379, 75.13, 85.4

See application file for complete search history.

(56) References Cited

U.S. PATENT DOCUMENTS

| | | | | |
|---|---|---|---|---|
| 3,427,048 | A * | 2/1969 | Brown | 285/18 |
| 3,831,676 | A * | 8/1974 | Brown et al. | 166/84.2 |
| 4,068,865 | A * | 1/1978 | Shanks, II | 285/90 |
| 4,553,591 | A * | 11/1985 | Mitchell | 166/86.2 |
| 4,606,557 | A * | 8/1986 | Coffey | 285/18 |
| 4,611,829 | A * | 9/1986 | Hughes | 285/18 |
| 4,653,778 | A * | 3/1987 | Alandy | 285/18 |
| 4,836,289 | A * | 6/1989 | Young | 166/379 |
| 4,923,006 | A * | 5/1990 | Hartmann et al. | 166/65.1 |
| 5,149,143 | A * | 9/1992 | Howell | 285/18 |
| 5,333,911 | A * | 8/1994 | Watkins | 285/18 |
| 6,328,343 | B1 * | 12/2001 | Hosie et al. | 285/90 |
| 7,267,179 | B1 | 9/2007 | Abel | |
| 7,308,934 | B2 * | 12/2007 | Swagerty et al. | 166/177.5 |
| 7,334,634 | B1 | 2/2008 | Abel | |
| 7,383,887 | B1 | 6/2008 | Abel | |
| 7,464,751 | B1 | 12/2008 | Abel | |
| 7,766,100 | B2 * | 8/2010 | Williams et al. | 175/195 |
| RE43,697 | E * | 10/2012 | Duhn | 285/123.1 |
| RE43,773 | E * | 10/2012 | Duhn | 285/123.1 |
| 8,316,948 | B2 * | 11/2012 | Stringfellow et al. | 166/367 |
| 8,505,652 | B2 * | 8/2013 | Williams | 175/195 |
| 8,567,508 | B2 * | 10/2013 | Villa | 166/368 |
| 8,573,328 | B1 * | 11/2013 | Ganzinotti et al. | 175/57 |
| 8,740,260 | B1 * | 6/2014 | Liew | 285/364 |
| 2008/0277120 | A1 * | 11/2008 | Hickie | 166/308.1 |

(Continued)

*Primary Examiner* — Jennifer H Gay

(74) *Attorney, Agent, or Firm* — Ted M. Anthony

(57) ABSTRACT

A method and apparatus for anchoring a wireline lubricator assembly in a well. A locking assembly having radial locking pin members is disposed between a bell nipple assembly and blowout preventer assembly. With a lubricator assembly properly positioned relative to the locking assembly, automated locking pin members equipped with locking blocks can be actuated to move between retracted positions and extended positions. In the extended position, the locking blocks engage against the lubricator assembly, locking the lubricator assembly in place and preventing axial movement of the lubricator assembly relative to the locking assembly.

6 Claims, 5 Drawing Sheets

(56) References Cited

U.S. PATENT DOCUMENTS

| | | | | |
|---|---|---|---|---|
| 2009/0032265 | A1* | 2/2009 | Borak et al. | 166/379 |
| 2009/0057024 | A1* | 3/2009 | Williams | 175/195 |
| 2011/0036589 | A1* | 2/2011 | Rodgers et al. | 166/360 |
| 2011/0214877 | A1* | 9/2011 | Stringfellow et al. | 166/341 |
| 2011/0266006 | A1* | 11/2011 | Lacheny et al. | 166/379 |
| 2012/0085545 | A1* | 4/2012 | Tarique et al. | 166/360 |
| 2013/0000885 | A1* | 1/2013 | Tucker | 166/75.13 |
| 2013/0048309 | A1* | 2/2013 | Young | 166/379 |

* cited by examiner

METHOD AND APPARATUS FOR SECURING A LUBRICATOR AND OTHER EQUIPMENT IN A WELL

CROSS REFERENCES TO RELATED APPLICATION

Priority of U.S. Provisional Patent Application Ser. No. 61/525,998, filed Aug. 22, 2011, and U.S. Provisional Patent Application Ser. No. 61/622,060, filed Apr. 10, 2012, both incorporated herein by reference, is hereby claimed.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention comprises a method and apparatus for performing operations in a well, such as wireline operations using a wireline lubricator assembly. More particularly, the present invention provides a method and apparatus for temporarily securing and sealing a vessel (such as a wireline lubricator) within a well in order to introduce and extract lengthy tool strings (such as wireline tools) to the well bore while encountering elevated wellbore pressures.

2. Brief Description of the Prior Art

During conventional drilling operations, a bore hole is drilled from the surface into the earth's crust through a wellhead assembly. A blowout preventer assembly is typically mounted to such wellhead assembly; such blowout preventer assembly usually includes an upper annular blowout preventer and one or more ram-type blowout preventers; when closed, said blowout preventers are designed to withstand fluid pressure from below. A bell nipple assembly is typically mounted to the upper annular blowout preventer of the blowout preventer assembly and extends upward toward the rig floor of a drilling rig or completion rig.

In most instances, said bell nipple assembly comprises a length of pipe having a relatively large diameter that extends from the uppermost extent of a blowout preventer assembly to a well opening at the drilling rig floor. The bell nipple typically serves as a "funnel" to guide drilling tools into and out of the upper opening of a well. Most conventional bell nipples also serve as conduits for drilling muds and/or other fluids present within a well.

Drill pipe or other tubular goods are usually inserted into a well and extend downwardly through the rotary drilling table, the bell nipple assembly, the blowout preventer assembly, the wellhead and downward into the well bore. Drilling mud or other fluids are usually introduced into the well through the drill pipe or other tubular goods to control reservoir pressures in the well. However, in the event that such reservoir pressure becomes excessive, the blowout preventers of the blowout preventer assembly may be actuated to seal off the upper opening of the well to control such excessive well pressures from below. For example, the annular blowout preventer may be closed around the outer surface of the drill pipe to seal off the annulus between the drill pipe and the surrounding casing or hole.

At certain times, particularly during completion of a well or during workover operations, a pipe string can be removed and various types of tools can be lowered into a well and suspended from a wireline or cable. Such wireline operations typically require the installation of a wireline lubricator assembly; on rigs and other installations without a permanent Christmas tree, the lubricator can be used, in conjunction with the blowout preventer assembly, to control pressure from below that may be encountered in a well while performing various wireline operations.

Generally, a lubricator assembly should be of sufficient size and length to totally contain the entire length and circumference of wireline tool or equipment being used. If desired (such as when well pressure is unexpectedly encountered while wireline operations are being performed) wireline tools can be retracted from the well bore up into the lubricator. Once the wireline tools are completely withdrawn inside the lubricator, the blind rams of the ram-type blowout preventers can be closed without contacting the wireline or any attached tools. The wireline tools and equipment can then be safely removed from the lubricator, the well pressure being contained below said blind rams.

One type of existing prior art wireline lubricator, frequently referred to as a "flange-type" lubricator, requires the removal of the entire bell nipple assembly prior to installation of such lubricator. Removal of a bell nipple frequently requires unbolting of many bolts from the flange connection between the bell nipple assembly and the blowout preventer assembly, as well as the connection between the flowline and the bell nipple assembly. Once the bell nipple assembly has been removed, the flange-type lubricator can be positioned on the uppermost end of the blowout preventer assembly and bolted thereto. The bolted connection between the lubricator and blowout preventer assembly must be able to withstand well pressure and requires testing for this purpose.

After wireline operations are completed, the flange-type lubricator assembly must then be unbolted and removed. Thereafter, the bell nipple assembly must be reattached to the blowout preventer assembly and the flowline must be reattached to the bell nipple assembly. Use of such flange-type lubricators can be very time consuming. The changing out of the bell nipple assembly and installation of the flange-type lubricator assembly may require several hours of rig time, which translates into costly rig rental charges.

Alternative lubricator devices have been developed in an effort to avoid the time and expense associated with conventional flange-type lubricators. In one embodiment, a lubricator assembly is inserted into the central bore of the blowout preventer assembly and bell nipple, and anchored in place using chains or other similar means. Although such chains or other anchoring means are arguably functional in applications involving low well pressures, this approach is not preferred when elevated well pressures are encountered.

Another alternative involves use of a spool member which is installed between the blowout preventer assembly and the bell nipple assembly. The spool has a plurality of locking pins radially movable between retracted positions (in which the pins to do not penetrate the spool bore), and extended positions (in which the pins penetrate the spool bore). A lubricator assembly includes a tubular mandrel which may be lowered and locked in the bore of the spool member in non-sealing engagement therewith by said locking pins. Unfortunately, as drilling operations encounter greater pressures, locking means having greater strength characteristics are required.

Existing methods for installing wireline lubricator assemblies suffer from a number of significant shortcomings. Thus, there is a need for an improved method and apparatus for quickly and efficiently locking a wireline lubricator assembly in place having greater strength characteristics than existing lubricator locking devices, and permitting operation in elevated pressures.

SUMMARY OF THE PRESENT INVENTION

In the preferred embodiment, the present invention comprises a spool member having a central bore, typically installed between a well's blowout preventer assembly and bell nipple assembly. The spool member has a plurality of pin drive assemblies radially movable between retracted positions (in which the pins and/or any locking blocks attached thereto do not penetrate the spool bore), and extended positions (in which the pins and/or any locking blocks attached thereto penetrate the spool bore). Locking blocks or dogs are attached to the inner ends of said locking pins closest to the central bore.

The present invention further comprises a mandrel assembly that can be attached to a lubricator assembly to work in conjunction with said spool assembly. In the preferred embodiment, said lubricator assembly beneficially includes a pressure control device at its top (such as, for example, a grease injection head, pack-off or other sealing means known to those having skill in the art) in order to provide a pressure seal around tubular, wireline, or any other means used to convey tools into and out of a well.

Said lubricator assembly can be lowered in to a well, such that the mandrel assembly is aligned with said spool member and disposed within the central bore of said spool member. Unlike cylindrical pins that each have a single point of contact with a mandrel, the locking blocks or dogs of the present invention provide significantly larger contact against said mandrel assembly. As a result, loading on said locking blocks or dogs is distributed over a larger surface area which makes the present invention much stronger than conventional locking devices. Further, the present invention provides the ability to increase the dimensions (vertical or horizontal) of the flange and locking blocks or dogs in order to provide increased strength characteristics.

In the preferred embodiment, the present invention further comprises a remotely operating system for actuating said pin drive assemblies. Such remote operating system can be actuated via hydraulic, pneumatic, electro mechanical, or other beneficial means, or combination thereof. Such remote operating system can: (1) reduce the time required for securing the lubricator assembly within a wellbore; and (2) increase safety by eliminating the need for personnel to physically actuate lock down pins. By contrast, existing systems frequently require at least one individual to climb the blowout preventer assembly, land a mandrel, and physically lock the lubricator assembly in place.

After a wireline operation is completed and the wireline or other internal tool string can be retracted above the rig's blind/sheer rams (such as in a lubricator assembly) the securing and sealing process described above can be reversed. The apparatus of the present invention can be removed from the well bore, together with any attached wireline lubricator or other equipment, and other "normal" rig operations can be conducted.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed. Further, dimensions, materials and part names are provided for illustration purposes only and not limitation.

DETAILED DESCRIPTION OF A PREFERRED EMBODIMENT OF THE INVENTION

Figure 7:
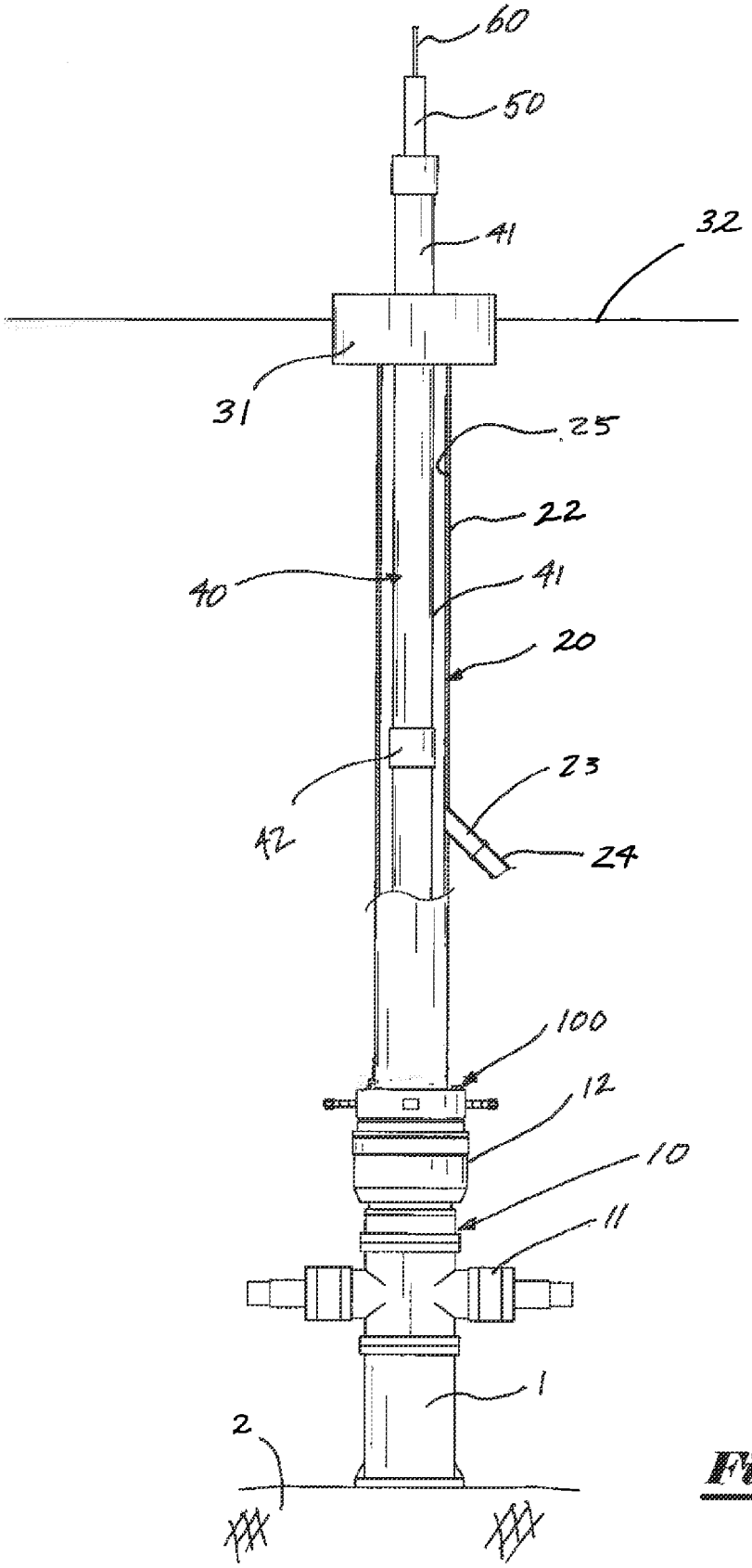
FIG. 7 depicts a side view of the apparatus of the present invention installed on a well.

Referring to the drawings, FIG. 7 depicts a side view of locking assembly 100 of the present invention installed in a typical well configuration such as, for example when a well is equipped with a conventional drilling or completion rig. As depicted in FIG. 7, wellhead 1 is installed at surface 2 of the earth's crust into which a well bore is being drilled such as, for example, a well drilled for the exploration for and/or production of hydrocarbons. Said well (not pictured in FIG. 7) extends downward from surface 2 into the subterranean portions of the earth's crust.

Mounted above wellhead 1 is blowout preventer assembly 10 which, in exemplary embodiment depicted in FIG. 7, includes various components such as ram-type blowout preventer 11 and annular blowout preventer assembly 12. Typically, most blowout preventer assemblies include one annular blowout preventer situated at or near the upper end of said blowout preventer assembly, and at least one ram-type blowout preventer(s) situated below such annular blowout preventer.

In accordance with the present invention, locking assembly 100 of the present invention (described in more detail below) can be mounted to the upper end of blow out preventer assembly 10. In most configurations, locking assembly 100 is mounted to the upper end portion of an annular preventer assembly 12, the uppermost component of blow out preventer assembly 10, as depicted in FIG. 7.

Extending upwardly from said locking assembly 100 is bell nipple assembly 20. Bell nipple assembly 20 generally comprises tubular body member 22, having a central bore defining internal surface 25. In the embodiment depicted in FIG. 7, said tubular body 22 of bell nipple assembly 20 extends upward and terminates at rotary drilling table 31 which is disposed at or near rig floor 32 or other similar support platform. It is to be observed that rig components 31 and 32, and other elements of a rig described herein are illustrative only and should not be construed as limiting, in that the present invention can be utilized in connection with a wide range of well components or (drilling or completion) rig configurations. Generally, the length of tubular body member 22 of bell nipple assembly 20 depends on the distance from locking assembly 100 to the rig floor of a particular rig.

In most instances, a driller or other personnel will be stationed on rig floor 32 and charged with the responsibility of observing and operating controls on a rig. In many instances during drilling operations, a string of drill pipe or other tubular goods may extend downwardly through rotary table 31, central bore of tubular body member 22 of bell nipple assembly 20, locking assembly 100, blowout preventer assembly 10 and wellhead 1, and into the subterranean portions (not shown) of a well.

Normally, drilling fluids are introduced into said drill string and circulated through the distal end of said tubular drill string for upward return through the annular space existing between the outer surface of the drill string and the inner surface of the wellbore (or casing). Said drilling fluids perform a number of functions including, without limitation, to cool downhole drill bits and carry drill cuttings and other materials upwardly through said annular space for exit through a flowline connection 23 of bell nipple assembly 20. Said flowline connection 23 is connected to a flowline 24 which typically extends to a mud pit, mud tanks or the like.

Drilling fluids also provide hydrostatic pressure to maintain pressure control in a well. However, in the event that said drilling fluids are unable to maintain said pressure control, blowout preventer assembly 10 (and, more specifically, ram preventers 11 and/or annular preventer assembly 12 thereof) may be actuated to seal such annular space contain any excessive pressure below said blowout preventer assembly. In some cases, a blind ram-type blowout preventer can also be included within blowout preventer assembly 10; said blind ram-type blowout preventers act to totally close a well when the drill pipe or other tubular goods have been removed therefrom.

In certain circumstances, it is desirable to utilize wireline tools to conduct certain operations within a well. Wireline tools are normally conveyed into and out of a well on a spool-able wireline or cable (including, without limitation, electric line, braided line or slick line). In many instances, it is typically necessary or desirable to remove drill pipe or other tubular goods from a well and install a wireline lubricator, such as lubricator assembly 40 depicted in FIG. 7, in order to conduct wireline operations. Wireline lubricator assembly 40 comprises a tubular body 41 defining a central through-bore (not shown in FIG. 7); in many cases, said tubular body 41 comprises a plurality of threaded joints that are joined together using coupling(s) 42.

Still referring to FIG. 7, in most cases, wireline lubricator assembly 40 is sized so that said tubular body 41 extends upwardly through rotary drilling table 31. Wireline pressure-control assembly 50 (which can be a grease injector or other similar device commonly used for providing a dynamic pressure seal against wireline) is installed at the upper end of said lubricator assembly 40. After wireline lubricator assembly 40 is in place, and cable or wireline 60 is inserted through pressure control assembly 50, wireline tools may be placed on the lower end of a cable or wireline 60. Said tools, not shown in FIG. 7, can be conveyed in and out of said well on cable or wireline 60.

Figure 1:
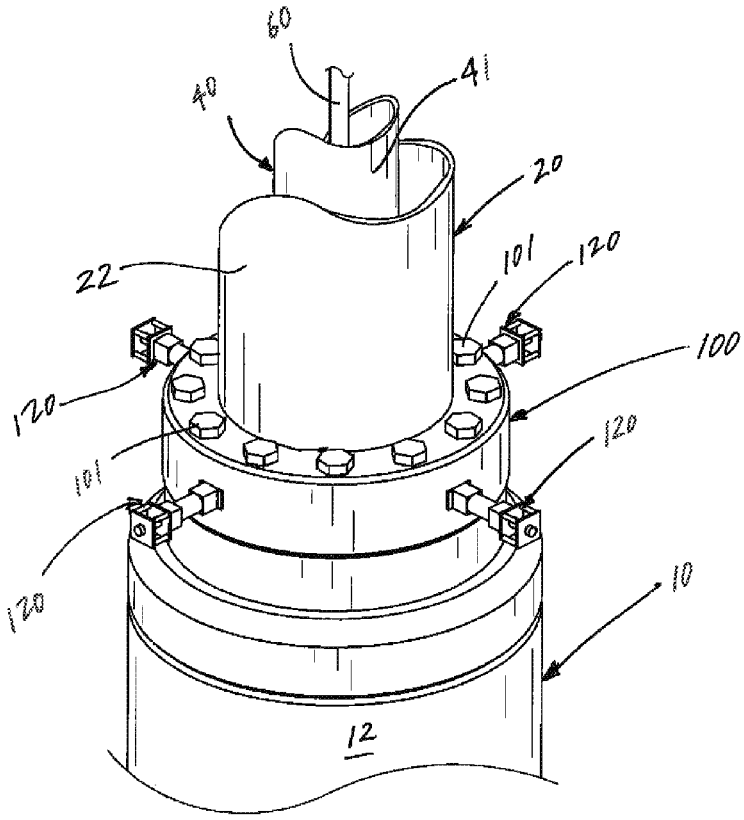
FIG. 1 depicts a side perspective view of the locking assembly of the present invention installed on a well.

Referring now to FIG. 1, bell nipple assembly 20 is surmounted on the upper surface of locking assembly 100. Said locking assembly 100 is provided with a plurality of holes or bores (not shown in FIG. 1) through which bolts or studs 101 extend for connection with corresponding aligned holes in annular blowout preventer assembly 12. If desired, ring type seal(s) may also be provided at this junction to assure a fluid-tight seal. Still referring to FIG. 1, wireline 60 is disposed within tubular body member 41 of lubricator assembly 40 which, in turn, is disposed within tubular body member 22 of bell nipple assembly 20. A plurality of locking pin drive assemblies 120 extend radially outward from said locking assembly 100.

Figure 2:
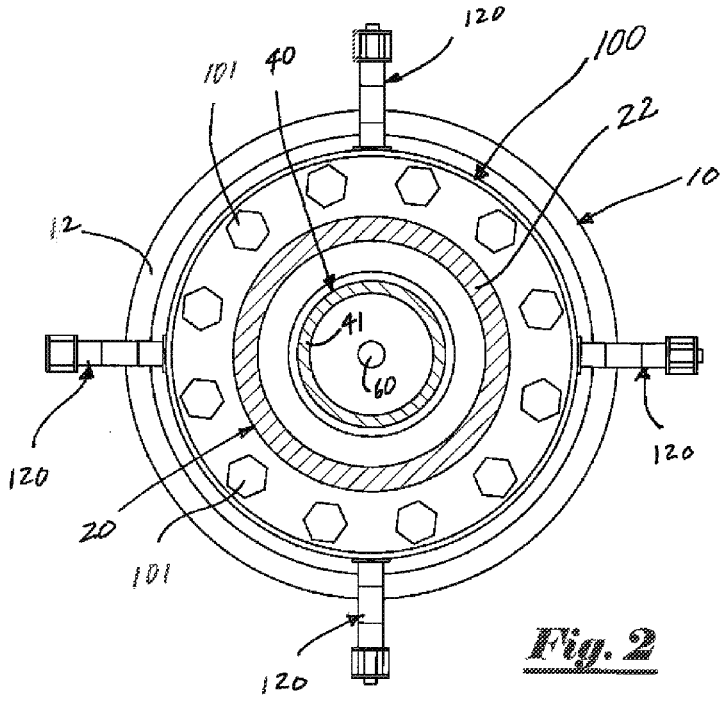
FIG. 2 depicts an overhead view of the locking assembly of the present invention depicted in FIG. 1

FIG. 2 depicts an overhead view of locking assembly 100 of the present invention depicted in FIG. 1. Bell nipple assembly 20 is surmounted on the upper surface of locking assembly 100, which is in turn mounted to annular preventer assembly 12 of blowout preventer assembly 10. A plurality of bolts 101 anchors locking assembly 100 to annular preventer assembly 12 of blowout preventer assembly 10. Wireline 60 is disposed within tubular body member 41 of lubricator assembly 40 which, in turn, is disposed within tubular body member 22 of bell nipple assembly 20. A plurality of locking pin drive assemblies 120 extend radially outward from said locking assembly 100.

Figure 3:
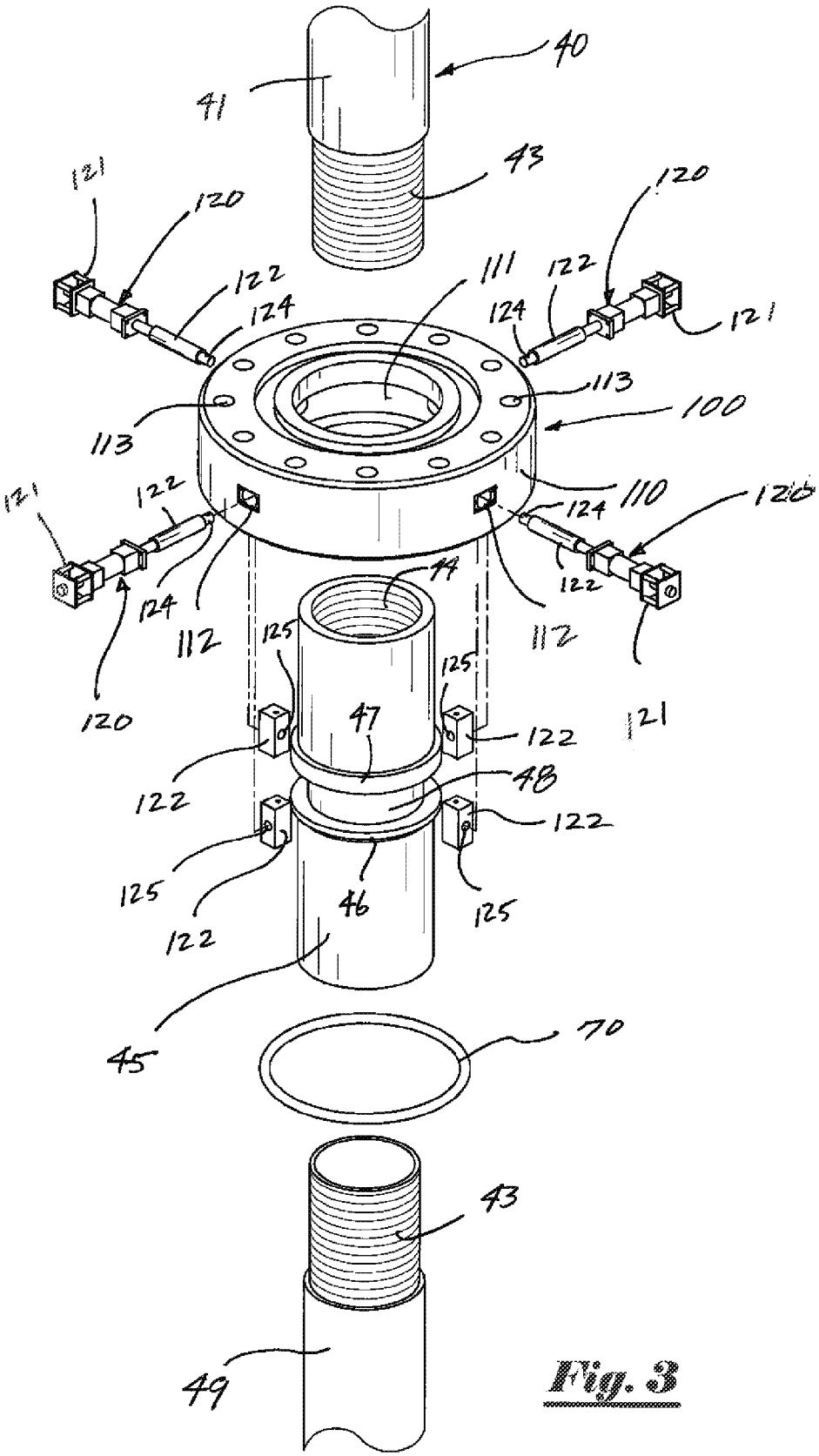
FIG. 3 depicts an exploded side perspective view of the locking assembly and related components of the present invention.

FIG. 3 depicts an exploded side perspective view of locking assembly 100 of the present invention, as well as components of lubricator assembly 40. In the embodiment depicted in FIG. 3, locking assembly 100 comprises flange-like body member 110 having a central through-bore 111. In the preferred embodiment, a plurality of bolt holes 113 are disposed around central through-bore 111 and oriented substantially parallel to said central through bore 111; said bolt holes can be aligned with corresponding holes in a bell nipple assembly and blow out preventer assembly for receiving anchor bolts (such as, for example, bolts 101 depicted in FIG. 1).

Flange-like body member 110 also has a plurality of radial bores 112. In the preferred embodiment, said radial bores are oriented substantially perpendicular to central through-bore 111, and extend from the outer surface of said flange-like body member 110 to central through-bore 111.

A locking pin drive assembly 120 is disposed within each of said bores 112. Said locking pin drive assemblies 120 each comprise an automated drive motor 121 connected to a drive pin 122. In the preferred embodiment, said automated drive motors 121 comprise linear actuators that, when actuated, selectively motivate locking pins 122 axially within radial bores 112. A locking block 123 is disposed at the distal end of each of said drive pins 122 (that is, the end of each drive pin 122 that is closest to central through bore 111). Although the means of attachment can vary, in the preferred embodiment an extension tip 124 at the end of each drive pin 122 is received within a mating hole 125 in each locking block 123.

Lubricator assembly 40 comprises central mandrel member 45 having upper circumferential ledge member 47 and lower circumferential ledge member 46. Said circumferential ledge member 47 and lower circumferential ledge member 46 define recessed slot. In the preferred embodiment, tubular body member 41 has threaded section 43 which can be threadedly connected to mating threads 44 of mandrel member 45 for joining said tubular body member 41 to mandrel member 45. Similarly, lower lubricator body section 49 also has threaded section 43 for threadedly connecting said lower lubricator body section 49 to central mandrel member 45. Alternatively, said mandrel member 45 can be integrally formed as a part of lubricator assembly 40.

Figure 4:
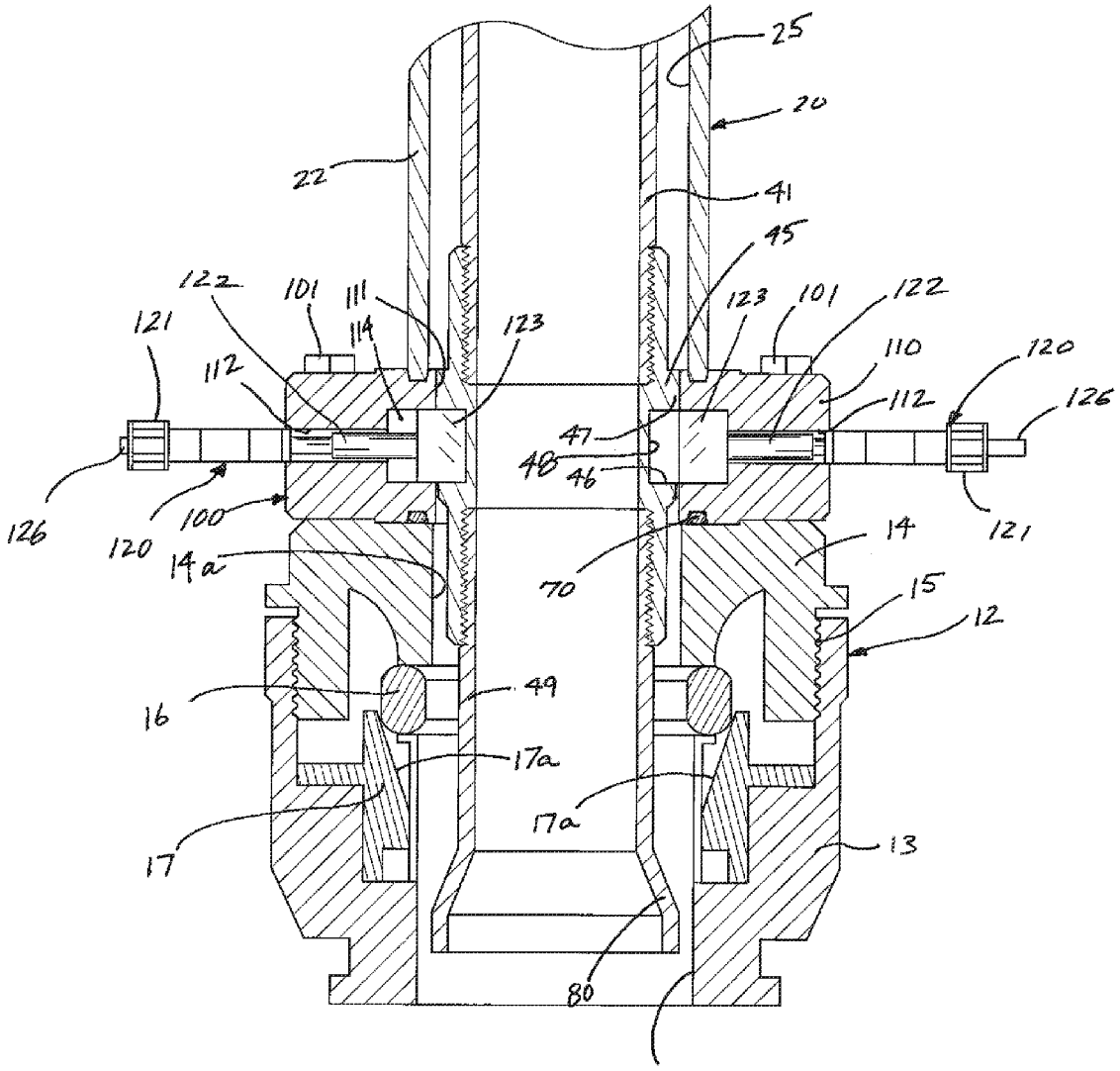
FIG. 4 depicts a side sectional view of the locking assembly of the present invention installed on a well.

FIG. 4 depicts a side sectional view of locking assembly 100 of the present invention installed on a well and, more particularly, the upper surface of a blowout preventer assembly. Annular blowout preventer assembly 12 comprises lower body member 13 and upper body member 14 joined at threaded connection 15. Supported within said annular blowout preventer assembly 12 is an annular seal member 16. Carried within an annular cavity of the body is an annular piston 17 having inclined surface **17*a*** which is mounted for reciprocal movement therein under the influence of hydraulic pressure.

The precise details of operation of an annular blowout preventer such as annular preventer assembly 12 is well known to those having skill in the art, and is not necessary for understanding the present invention. Rather, it is sufficient to understand that movement of annular piston 17 in an upwardly direction will, through the engagement of an inclined surface 17*a* with annular seal 16, cause said annular seal 16 to contract and sealingly engage any cylindrical member extending aligned central bores 13*a* of annular preventer lower body member and 14*a* of annular preventer upper body member. As depicted in FIG. 4, such a cylindrical member is the lower tubular body member 49 of wireline lubricator assembly 40 which can be equipped with optional flared wireline re-entry guide 80.

In accordance with the present invention, locking assembly 100 of the present invention (described in more detail below) is mounted to the upper end of annular preventer assembly 12. Extending upwardly from said locking assembly 100 is bell nipple assembly 20 comprising tubular body member 22 having a central bore defining internal surface 25. As depicted in FIG. 4, said tubular body member 22 of bell nipple assembly 20 is permanently joined with body member 110 of locking assembly 100; however, it is to be observed that said lubricator assembly 20 can be connected to said locking assembly 100 in many different ways including, without limitation, using a bolted flange mechanism.

Body member 110 of locking assembly 100 is provided with a plurality of holes or bores (not shown in FIG. 4) through which bolts or studs 101 extend for connection with corresponding aligned holes in annular blowout preventer assembly 12. Seal ring 70 is provided to assure a fluid-tight seal between said body member 110 of locking assembly 100 and annular preventer assembly 12. Tubular body member 41 of lubricator assembly 40 is disposed within tubular body member 22 of bell nipple assembly 20.

Flange-like body member 110 also has a plurality of transverse radial bores 112. In the preferred embodiment, said radial bores are oriented substantially perpendicular to central through-bore 111, and extend from the outer surface of said flange-like body member 110 to central through-bore 111. Said radial bores 112 are larger near said central through-bore 111, thereby defining enlarged recess areas 114.

A locking pin drive assembly 120 is disposed within each of said bores 112. Said locking pin drive assemblies 120 each comprise an automated drive motor 121 connected to a drive pin 122. In the preferred embodiment, said automated drive motors 121 each comprise linear actuators that, when actuated, selectively motivate locking pins 122 axially within radial bores 112. A locking block 123 is disposed at the distal end of each of said drive pins 122 (that is, the end of each drive pin 122 that is closest to central through bore 111). Said locking blocks are generally aligned with recess areas 114.

Lubricator central mandrel member 45 having opposing upper circumferential ledge member 47 and lower circumferential ledge member 46. Said circumferential ledge member 47 and lower circumferential ledge member 46 define recessed slot 48. In the preferred embodiment, tubular body member 41 is threadedly connected to the upper portion of mandrel member 45, while lower lubricator body section 49 is threadedly connecting said lower lubricator body section 49. In the preferred embodiment, upper ledge member 47 has a larger outer diameter than lower ledge member 46.

In the preferred embodiment, locking pin members 122 are beneficially provided with indicia (such as, for example, scribes or other markings) by which it can be determined when said pin members 122 are fully or partially extended or retracted. Although indicia can be provided at different locations, such indicia can be beneficially provided near outer end 126 of pin members 122 so that said indicia is visible from the outer periphery of the flange-like body member 110. Each of said pin members 122 may also be provided, at a specified distance from the inner ends thereof, with a transverse hole through which a cotter pin or other safety pin may be received to prevent said pin members from being moved to their second or penetrating positions.

It will be noted that the lower tubular body member 49 of wireline lubricator assembly 40, when installed as in FIG. 4, projects through the central through bore of annular blowout preventer assembly 12 to prevent damage to the annular blowout preventer and particularly the annular seal 16 thereof from wirelines or wireline tools passing therethrough. It will also be noted that the lower end of lower body section 49 can be optionally provided with an enlarged centralizing portion 80 the external diameter of which is greater than the external diameter of lower body section 49, but less than the internal diameter of the bore of annular preventer assembly 12, which aids in centering wireline lubricator assembly 40 as it is being lowered into place. Fluid communication can be established between the interiors of the upper and lower tubular body members 41 and 49, and through the bore of mandrel member 45.

Figure 5:
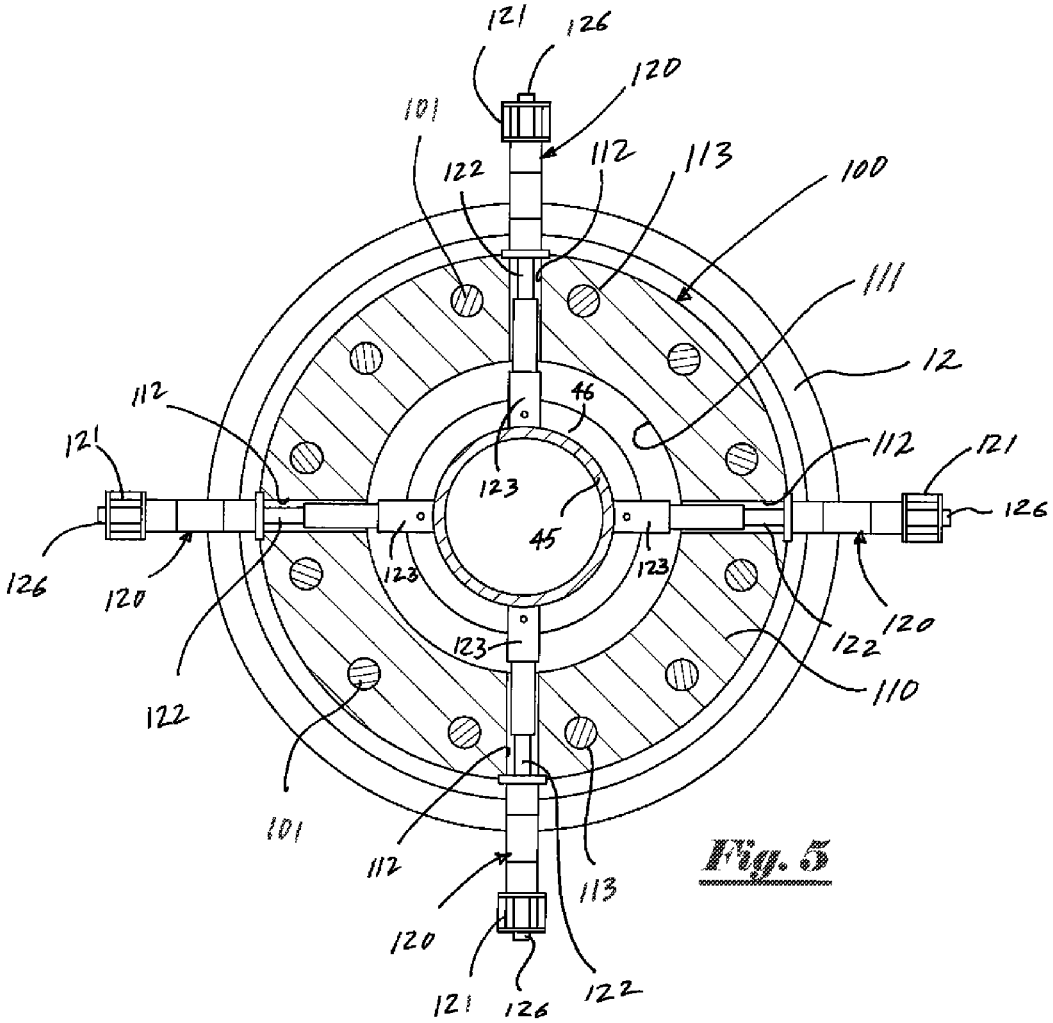
FIG. 5 depicts an overhead sectional view of the locking assembly of the present invention depicted in FIG. 4.

FIG. 5 depicts an overhead sectional view of locking assembly 100 of the present invention depicted in FIG. 4. In accordance with the present invention, body member 110 of locking assembly 100 of the present invention is mounted to the upper end of annular preventer assembly 12. Body member 110 of locking assembly 100 is provided with a plurality of holes or bores 113 through which bolts or studs 101 disposed around central through-bore 111. Said bolts or studs 101 can connect body member 110 with corresponding aligned holes in annular blowout preventer assembly 12.

Flange-like body member 110 also has a plurality of radial bores 112. In the preferred embodiment, said radial bores are oriented substantially perpendicular to central through-bore 111, and extend from the outer surface of said flange-like body member 110 to central through-bore 111.

A locking pin drive assembly 120 is disposed within each of said bores 112. Said locking pin drive assemblies 120 each comprise an automated drive motor 121 connected to a drive pin 122. In the preferred embodiment, said automated drive motors 121 each comprise linear actuators that, when actuated, selectively motivate locking pins 122 axially within transverse radial bores 112. A locking block 123 is disposed at the distal end of each of said drive pins 122 (that is, the end of each drive pin 122 that is closest to central through bore 111). Lubricator central mandrel member 45 has lower circumferential ledge member 46.

Locking pin members 122 can be beneficially provided with indicia (such as, for example, scribes or other markings) by which it can be determined when said pin members 122 are fully or partially extended or retracted. Although indicia can be provided at different locations, such indicia can be beneficially provided near outer end 126 of pin members 122 so that said indicia is visible from the outer periphery of the flange-like body member 110. Additionally, said locking pin assemblies 120 of the present invention can also be equipped with sensors that detect the position of locking pin members 122 and/or locking blocks 123, and relay such information to a computer processor.

Figure 6:
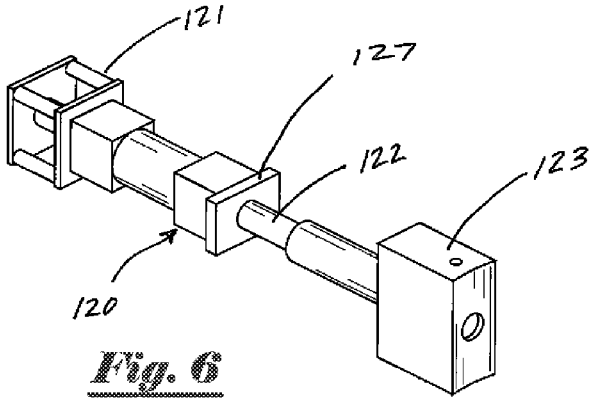
FIG. 6 depicts a side perspective view of a locking pin assembly of the present invention.

FIG. 6 depicts a side perspective view of a locking pin assembly 120 of the present invention. Said locking pin assembly 120 comprises automated drive motor 121 connected to drive pin 122. Locking block 123 is disposed at the distal end of said drive pin 122. Optional mounting plate 127 can be provided where locking pin assembly 120 meets the outer surface of body member 110 when said locking pin assembly 120 is received within bore 112 locking assembly 100.

In operation, bell nipple assembly 20 is surmounted on locking assembly 100, which is in turn surmounted on annular preventer assembly 12 as a rig is initially configured. Locking pin members 122 are retracted so that such pins (or, more properly, locking blocks 123) do not penetrate or extend into the central bore of the flange-like body member 110. Such components are generally retained in such positions while normal drilling or other operations are performed.

When it is desired to perform wireline operations, any drill string or other similar tubular goods are first removed from a well. Referring to FIG. 4, wireline lubricator assembly 40 is lowered into the bell nipple assembly 20 until mandrel member 45 is aligned within central bore 111 of body member 110 of locking assembly 100.

In the preferred embodiment, one or more locking pin members 122 can be extended a relatively small amount such that locking blocks 123 protrude a predetermined amount into central bore 111 of body member 110. Because the outer diameter if lower circumferential ledge 46 is smaller than the outer diameter of upper circumferential ledge 47, said lower ledge 46 can pass said partially extended locking blocks 123 as said lubricator assembly 20 is lowered. However, upper circumferential ledge will not clear said locking blocks 123, and downward movement of said lubricator assembly 20 is arrested by engagement of said upper circumferential ledge 47 with said locking blocks. In this manner, mandrel member 45 can be "landed" within central bore 111 of body member 110, assuring proper axial alignment of mandrel member 45 relative to said body member 110 and locking blocks 123.

Still referring to FIG. 4, once mandrel member 45 is landed, wireline lubricator assembly 40 is properly positioned. Drive motors 121 can be actuated, thereby motivating locking pin members 121 radially inward within bores 112. Locking blocks 123 are received within recessed slot 48 formed between opposing circumferential ledge members 46 and 47 of mandrel member 45. In the preferred embodiment, when engaged against mandrel member 45 in this manner, the thickness of said locking blocks 123 are substantially evenly divided between recess area 114 of locking assembly 100 and recessed slot 48 of mandrel member 45. Indicia at or near end 126 of locking pin members 121 provide visual "tattle-tale" indication when said pin members 121 in a fully extended or engaged positions. Alternatively, sensors can relay to a computer processor when said pin members 121 are in a fully engaged position, such that locking blocks 123 are received a desired amount within recessed slot 48 of mandrel member 45.

Unlike prior art cylindrical locking pins that each have a single point of contact with a lubricator assembly, locking blocks 123 of the present invention provide significantly larger contact against said mandrel member 45 (and upper circumferential ledge member 47 and lower circumferential ledge member 46). As a result, loading on said locking blocks 123 is distributed over a significantly larger surface area which makes the present invention much stronger than conventional locking devices—and especially "pin type" locking devices that typically have much less surface area contacting the mandrel member and/or lubricator assembly. In many cases, in the "locked" or secured positions, said locking blocks 123 are partially disposed between recess area 114 of locking assembly 100 and recessed slot 48 of mandrel member 45. Further, the dimensions of locking blocks 123 (including, without limitation, the vertical dimension) can be increased or adjusted in order to provide increased shear strength characteristics and prevent axial movement of lubricator assembly 40 relative to locking assembly 100.

In the preferred embodiment, the present invention further comprises a remotely operating system for actuating said locking pin drive assemblies 120. Such remote operating system can be actuated via hydraulic, pneumatic, electro mechanical, or other beneficial means, or combination thereof. Such remote operating system can: (1) reduce the time required for securing lubricator assembly 40 within locking assembly 100; and (2) increase safety by eliminating the need for personnel to physically access locking assembly 100 to actuate lock down pins and move locking blocks 123 in place.

With said wireline lubricator assembly 40 properly located and locked in place, wireline tools can be installed within said lubricator assembly 40, and wireline pressure control assembly 50 can be actuated. At this point, if desired, the pressure integrity of wireline lubricator assembly 40 and blowout preventer assembly 10 can be tested by temporarily closing blind ram-type blowout preventers (below said lubricator assembly 40) and annular blowout preventer assembly 12 (around the outer surface of lower body member 49 of lubricator assembly 40) while introducing pressure into said lubricator assembly. This will disclose whether or not any leaks exist in lubricator assembly 40 or blowout preventer assembly 10. Thereafter, wireline tools (not shown in FIG. 4) may be lowered into the well for the down hole operations to be performed using such tools.

In one embodiment of the present invention, a transverse bore, groove or notch can be formed in opposing circumferential ledge members 46 and 47 of mandrel member 45 in order to form a fluid bypass path. During certain operations, it may be beneficial to leave annular preventer assembly 12 open (that is, not sealed against the outer surface of lubricator assembly 40). In this configuration, fluid levels and fluid returns from a well can be monitored to determine whether formation fluids are entering the well, the well is taking a "kick", or other unsafe conditions are being experienced. If desired, annular preventer assembly 12 can be closed to seal the annular area around the outer surface of lubricator assembly 40.

Should excessive well pressures be encountered while wireline operations are being performed, or after wireline operations are completed, said wireline tools may be pulled up into the lubricator assembly 40. Once the tools are completely inside the lubricator assembly 40, the blind ram-type blowout preventers of blow out preventer assembly 10 may be closed, thereby isolating said lubricator assembly 40 and wireline tools from well pressure.

With the blind ram-type blowout preventers closed below the lubricator assembly 40, pressure can be released from said lubricator assembly 40 in a controlled manner. Thereafter, wireline tools can be safely removed from said lubricator assembly 40. Wireline lubricator assembly 40 can be easily removed simply by actuating drive motors 121 to motivate locking pin members 122 radially outward from their fully extended or locked positions. As this occurs, locking blocks 123 are fully retracted from recessed slot 48, thereby allowing release of mandrel member 45 and all of the components of the lubricator assembly 40. After said lubricator assembly 40 is removed, normal rig operations can then proceed. It is important to note that the bell nipple assembly 20 remains in place at all relevant times, and does not require removal for installation of the wireline lubricator assembly 40.

Thus, the apparatus of the present invention provides apparatus for performing wireline operations in a well without removal of the bell nipple assembly and by simply lowering the lubricator apparatus into place and locking it into place with minor effort. Not only is the apparatus and its method of use extremely safe, it can be installed in much less time than wireline equipment of the prior art, saving significant time and resulting expense.

While the present invention has been described primarily in connection with drilling operations, it may be utilized for any drilling, completion or workover operation in which wireline tools are needed. Furthermore, the apparatus of the present invention might be utilized in operations other than wireline operations. Although the invention has been described for wireline operations, it is not intended to be limited to such.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A lockdown apparatus for securing a lubricator assembly comprising:

a) a flange member surmounted on a blowout preventer assembly having a through bore, said flange member having a central bore aligned with said through bore of said blowout preventer assembly, and at least one substantially vertical transverse bore extending from the outer peripheral surface of said flange to said central bore;

b) a pin member slidably disposed within each of said at least one transverse bores and defining at least a first position and a second position;

c) a substantially rectangular locking block disposed at the end of each of said at least one pin members nearest the central bore of said flange, wherein each of said substantially rectangular locking blocks have a greater vertical thickness than said at least one pin member, and define a substantially greater surface area than said at least one pin member; and d) a mandrel member connected to a lubricator assembly, said mandrel member comprising a recessed groove adapted to receive a portion of said substantially rectangular locking block;

wherein in said first position each locking block is positioned within said flange member, while in said second position a portion of each locking block is received in said recessed groove and a portion of each locking block is received in said flange member.

2. The lockdown apparatus of claim 1, wherein said flange member is disposed between a bell nipple assembly and said blowout preventer assembly.

3. The lockdown apparatus of claim 2, wherein said flange member is integrally formed with said bell nipple assembly.

4. The lockdown apparatus of claim 1, further comprising a drive motor adapted to move said pin members within said at least one transverse bore.

5. The lockdown apparatus of claim 4, wherein said drive motor is hydraulically powered.

6. The lockdown apparatus of claim 4, wherein said drive motor is pneumatically powered.

* * * * *